US009011168B2

(12) United States Patent
Brown

(10) Patent No.: US 9,011,168 B2
(45) Date of Patent: Apr. 21, 2015

(54) ELECTRICAL CONNECTION SYSTEMS, ELECTRICAL APPARATUSES, AND ELECTRICAL CONNECTION MEMBERS

(71) Applicant: Valence Technology, Inc., Las Vegas, NV (US)

(72) Inventor: Cary L. Brown, Austin, TX (US)

(73) Assignee: Valence Technology, Inc., Las Vegas, NV (US)

( * ) Notice: Subject to any disclaimer, the term of this patent is extended or adjusted under 35 U.S.C. 154(b) by 70 days.

(21) Appl. No.: 13/677,080

(22) Filed: Nov. 14, 2012

(65) Prior Publication Data

US 2014/0134865 A1 May 15, 2014

(51) Int. Cl.

| | |
|---|---|
| ***H01R 13/52*** | (2006.01) |
| ***H01R 11/28*** | (2006.01) |
| *H01R 13/447* | (2006.01) |

(52) U.S. Cl.

CPC ..... *H01R 13/5219* (2013.01); *H01R 11/281* (2013.01); *H01R 13/447* (2013.01)

(58) Field of Classification Search

USPC ..... 439/271, 733.1, 578–585, 500, 275

See application file for complete search history.

(56) References Cited

U.S. PATENT DOCUMENTS 3,824,526 A * 7/1974 Glover ..... 439/272
4,886,471 A * 12/1989 Fleshman, Jr. ..... 439/587
4,986,764 A * 1/1991 Eaby et al. ..... 439/275
7,544,094 B1 6/2009 Paglia et al.
7,618,276 B2 11/2009 Paglia et al.
7,824,218 B2 11/2010 Gleissner et al.
8,734,191 B2 * 5/2014 Zhao ..... 439/701

OTHER PUBLICATIONS

Amphe-Power Connectors with RADSOK Technology, http://datasheet.octopart.com/C10-638975-000-Amphenol-datasheet-3673.pdf, Amphenol, Nov. 13, 2012, 18 pp.

* cited by examiner

*Primary Examiner* — Edwin A. Leon
(74) *Attorney, Agent, or Firm* — Wells St. John P.S.

(57) ABSTRACT

Electrical connection systems, electrical apparatuses, and electrical connection members are described. In one aspect, an electrical connection system includes a receptacle connection member which includes an electrically conductive sleeve, and an electrically insulative member about at least a portion of an exterior surface of the sleeve, and an insertion connection member which includes an electrically conductive post which is configured to be electrically coupled with an interior surface of the sleeve when the post is inserted into the sleeve, and an electrically insulative member about at least a portion of an exterior surface of the electrically conductive post, and wherein the electrically insulative member of the insertion connection member is spaced from the electrically conductive post, and wherein the electrically insulative member of the receptacle connection member is received between the electrically conductive post and the electrically insulative member of the insertion connection member when the post of the insertion connection member is inserted into the receptacle connection member.

26 Claims, 11 Drawing Sheets

ELECTRICAL CONNECTION SYSTEMS, ELECTRICAL APPARATUSES, AND ELECTRICAL CONNECTION MEMBERS

TECHNICAL FIELD

The present disclosure relates to electrical connection systems, electrical apparatuses, and electrical connection members.

BACKGROUND

Numerous different sources of electrical energy are available and used in a wide variety of applications and industries. For example, automotive industries may utilize batteries, fuel cells, or other sources of electrical energy for providing power, perhaps for starting a gasoline engine or powering an electrical motor. Many different housings and connections exist for interconnecting the electrical energy sources with one another or with other components of the device in which the electrical energy sources are utilized. In one example, typical battery terminations involve the use of threaded fasteners which may be suitable for many different implementations, including use with automobiles. However, these systems may be unsuitable for other implementations, for example, implementations where it may be desirable for a watertight interconnection, such as an implementation within a marine vessel.

At least some aspects of the disclosure are directed towards electrical connection members, electrical connection systems, and electrical apparatus as described below.

BRIEF DESCRIPTION OF THE DRAWINGS

Example embodiments of the disclosure are described below with reference to the following accompanying drawings.

DESCRIPTION

Figure 1:
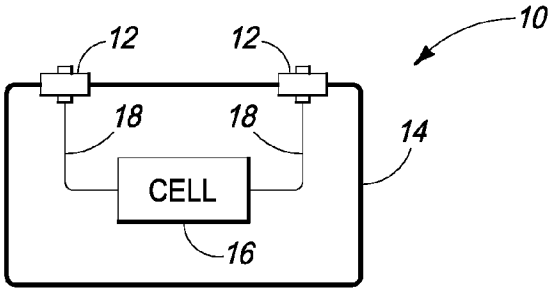
FIG. 1 is an illustrative representation of an electrical apparatus according to one embodiment.

This disclosure is submitted in furtherance of the constitutional purposes of the U.S. Patent Laws "to promote the progress of science and useful arts" (Article 1, Section 8).

At least some aspects of the disclosure are directed towards electrical connection members, electrical connection systems, and electrical apparatus as described below. In some embodiments, electrical connection members and systems are provided which are watertight and submersible, and for example, may be implemented at a terminal battery connection which may be used in a maritime application. Furthermore, different electrical connection members may be electrically coupled with one another to form an electrical connection system and uncoupled from each other without the use of tools in some example embodiments.

According to one embodiment, an electrical connection system includes a receptacle connection member comprising an electrically conductive sleeve, and an electrically insulative member about at least a portion of an exterior surface of the sleeve, and an insertion connection member comprising an electrically conductive post which is configured to be electrically coupled with an interior surface of the sleeve when the post is inserted into the sleeve, and an electrically insulative member about at least a portion of an exterior surface of the electrically conductive post, and wherein the electrically insulative member of the insertion connection member is spaced from the electrically conductive post, and wherein the electrically insulative member of the receptacle connection member is received between the electrically conductive post and the electrically insulative member of the insertion connection member when the post of the insertion connection member is inserted into the sleeve.

According to an additional embodiment, an electrical apparatus comprises electrically insulative housing electrical circuitry within an interior of the housing, and at least one terminal comprising a receptacle connection member which is electrically coupled with electrical circuitry within the interior of the housing, and wherein the receptacle connection member comprises an electrically conductive sleeve which defines a terminal opening and which is configured to receive and electrically couple with an insertion connection member, and wherein the receptacle connection member comprises an electrically insulative member which forms a seal with an electrically insulative member of the insertion connection member to insulate the receptacle and insertion connection members from an environment outside of the housing when the receptacle and insertion connection members are electrically coupled with one another.

According to another embodiment, an electrical connection member comprises an electrically conductive lug, an electrically conductive post electrically coupled with the lug and configured to be electrically coupled with an electrically conductive sleeve of another electrical connection member when the post is inserted into the sleeve, and an electrically insulative member about the electrically conductive post and configured to form a seal with an electrically insulative member of the another electrical connection member when the post is inserted into the sleeve.

Referring to FIG. 1, an example electrical apparatus 10 is shown which includes a plurality of terminals 12 which provide electrical coupling of circuitry which is internal of a housing 14 to external circuitry which is outside of the housing 14 (the external circuitry is not shown in FIG. 1).

In one embodiment, the electrical apparatus 10 is a battery and the internal circuitry includes an electrochemical cell 16 and electrical connections 18 which electrically connect an anode and cathode of the cell 16 to the terminals 12 including negative and positive terminals, respectively. In one example embodiment, terminals 12 may individually include female or receptacle connection members which are configured to electrically couple with male or insertion connection members (the male connection members are not shown in FIG. 1). Together, the receptacle and insertion connection members of a terminal 12 may also be referred to as an electrical connection system in one embodiment.

Figure 2:
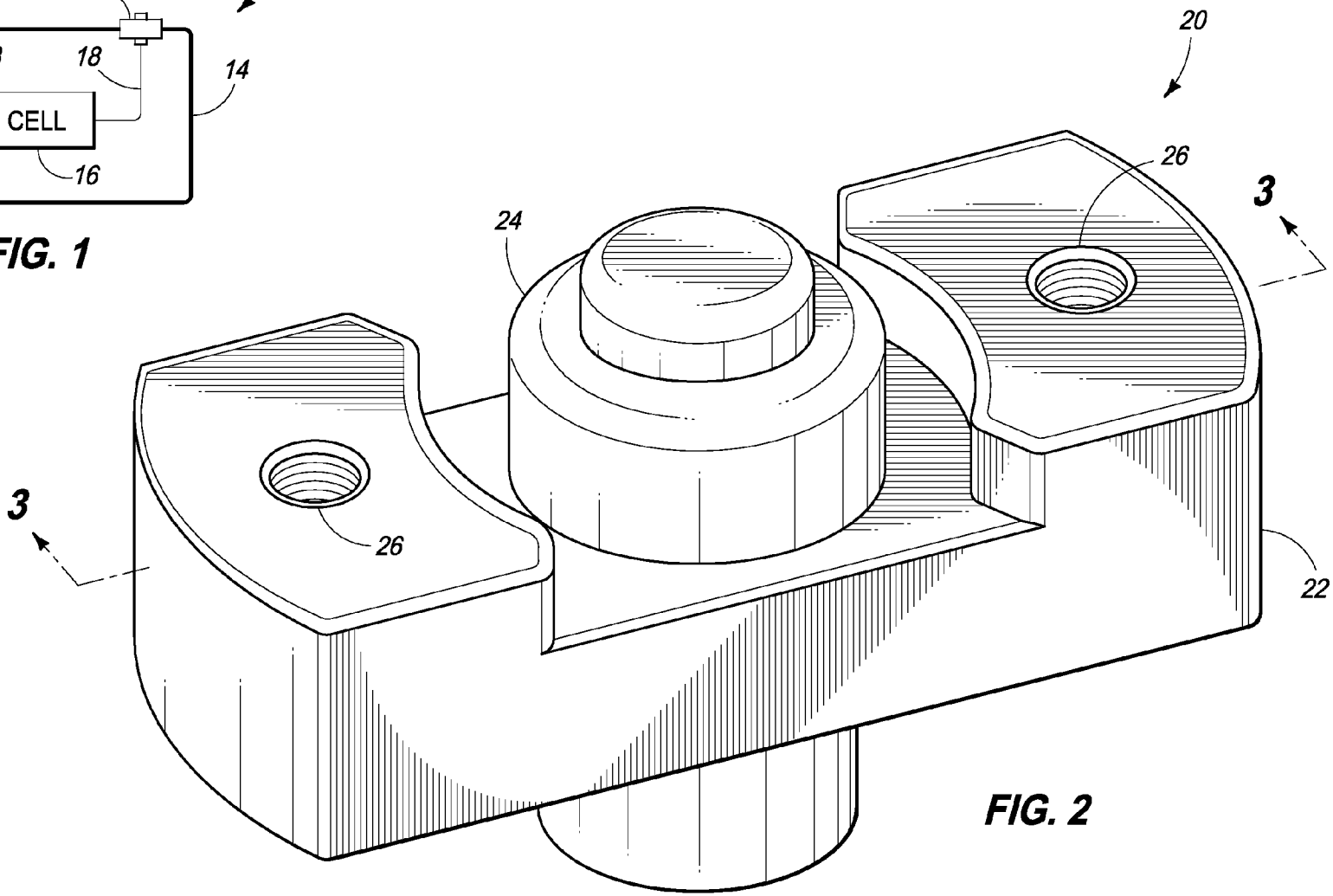
FIG. 2 is a perspective view of a receptacle connection member of an electrical connection system according to one embodiment.

Referring to FIG. 2, an example embodiment of a receptacle connection member 20 is shown. The illustrated example receptacle connection member 20 includes a metallic electrically conductive terminal block 22 and an electrically conductive sleeve 24. The upper portion of the receptacle connection member 20 shown in FIG. 2 is provided within the interior of housing 14 of electrical apparatus 10 in one embodiment. The bottom end of sleeve 24 shown in FIG. 2 has an aperture or opening which receives the insertion connection member (the aperture is shown in an example embodiment in FIGS. 3, 5 and 6) in one embodiment. Sleeve 24 may be embodied as an Amphenol Radsok spring-sleeve terminal in one configuration. Block 22 includes a plurality of fastener locations 26 for internal connections (e.g., connections to internal circuitry including electrochemical cell 16 and connections 18) and which may be implemented as threaded holes in one embodiment.

Figure 3:
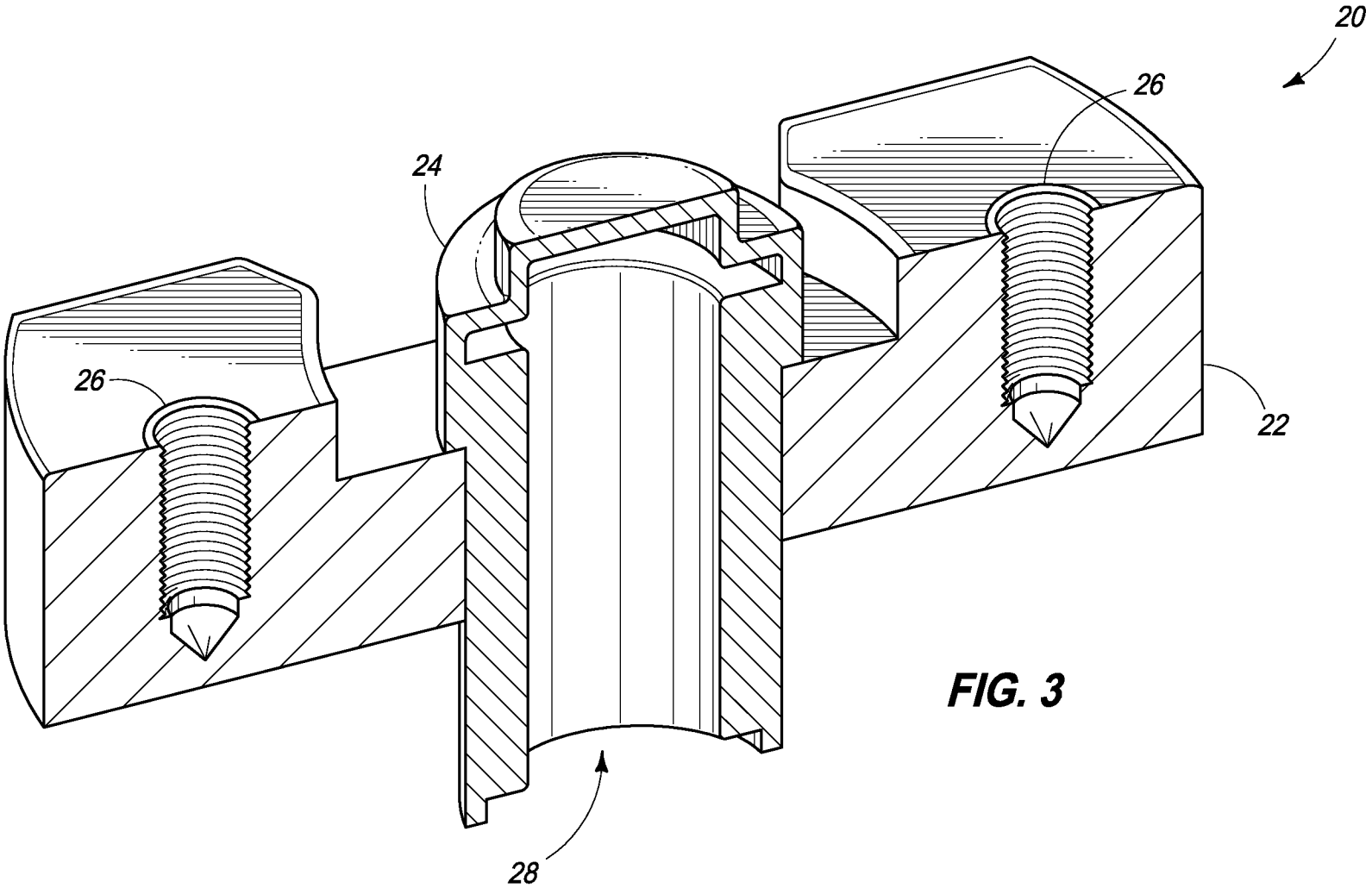
FIG. 3 is a cross-sectional view of a receptacle connection member of an electrical connection system according to one embodiment.

Referring to FIG. 3, the sleeve 24 and block 22 are electrically coupled with one another in one embodiment. For example, the sleeve 24 may be press-fit into the block 22. In another example, a welded interface may be provided between the block 22 and sleeve 24. Accordingly, block 22, fastener locations 26 and sleeve 24 are electrically coupled with one another in some embodiments. Sleeve 24 shown in FIG. 3 includes an opening or aperture 28 as mentioned above.

Figure 4:
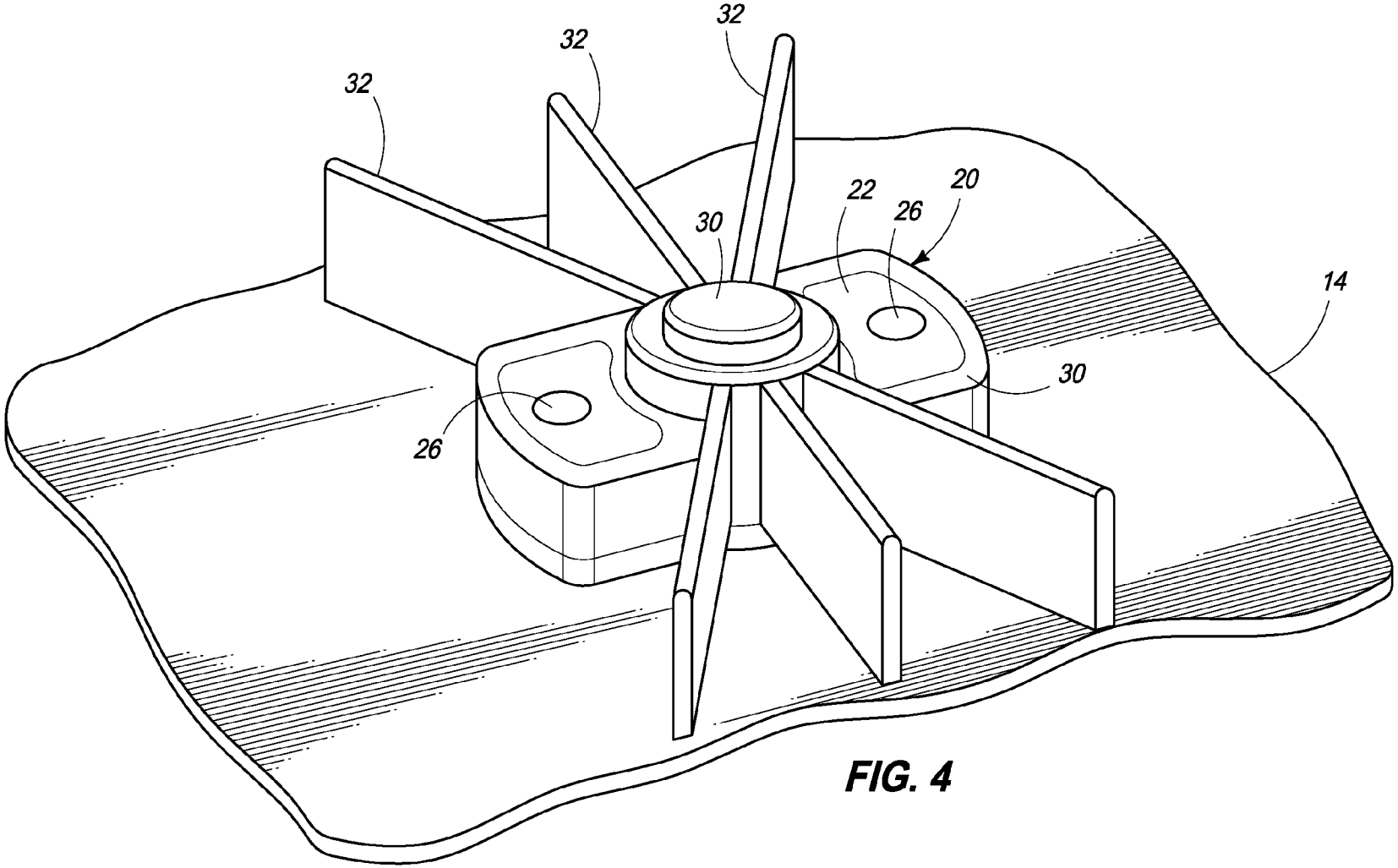
FIG. 4 is a perspective view of a receptacle connection member within an interior of a housing according to one embodiment.

Referring to FIG. 4, an interior portion of housing 14 of electrical apparatus 10 is shown. The receptacle connection member 20 is shown coupled with the housing 14. In one embodiment, the receptacle connection member 20 is insert-molded into the housing 14 with the fastener locations 26 exposed to the interior of the housing 14 of the electrical apparatus 10 and which may be coupled with circuitry internal of the housing 14 as discussed above. An electrically insulative plastic molding material 30 is provided about the block 22 and sleeve 24 and outwardly exposes the fastener locations 26 for electrical connection to interior circuitry within housing 14. In one embodiment, fastener locations 26 may be connected to a nickel-plated copper plate (not shown) connected by threaded fasteners and/or other electrical circuitry. Furthermore, the molding material may also be formed to provide reinforcing ribs 32 within the interior of the housing 14 for structural purposes and which may vary differently in different implementations.

Figure 5:
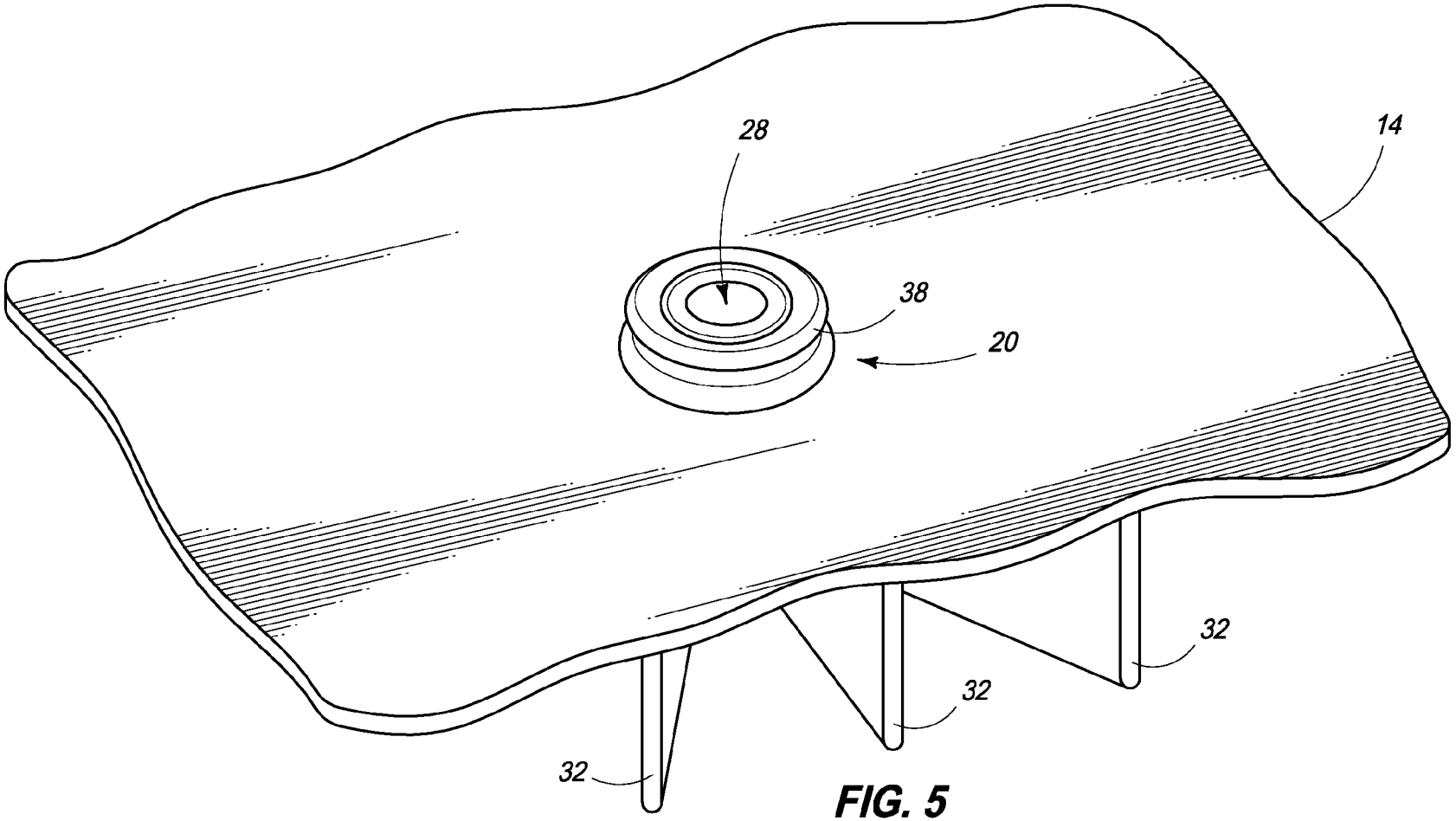
FIG. 5 is a perspective view of a receptacle connection member at an exterior of a housing according to one embodiment.
Figure 6:
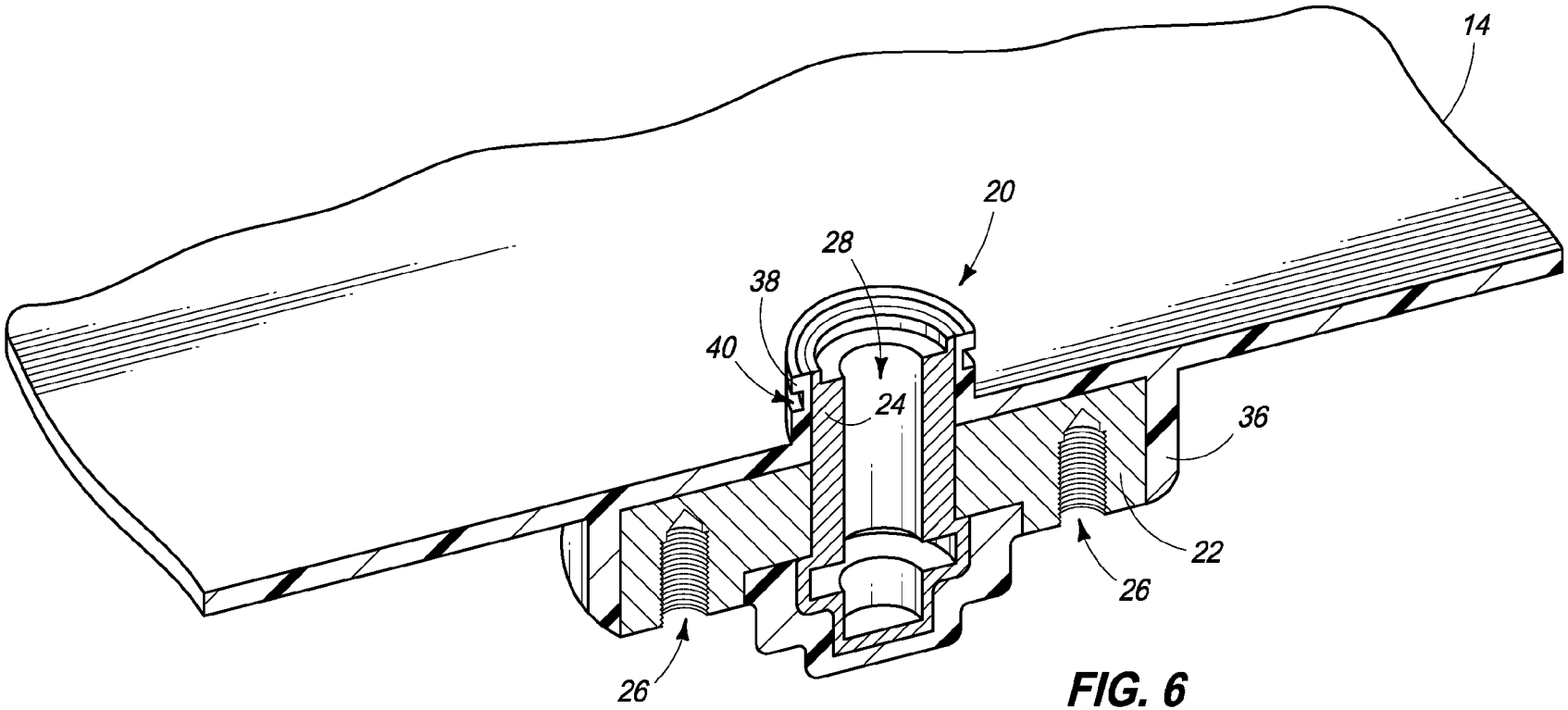
FIG. 6 is a cross-sectional view of a receptacle connection member at an exterior of a housing according to one embodiment.

Referring to FIGS. 5 and 6, an exterior portion of housing 14 of electrical apparatus 10 is shown. Aperture or opening 28 defined by the sleeve 24 of receptacle connection member 20 is shown outwardly exposed at the exterior portion of housing 14 and which may receive an insertion connection member as discussed further below in one embodiment. An electrically insulative member 38, such as plastic molding material, is provided about a portion of sleeve 24 which extends outwardly of housing 14 in the example FIG. 5. Member 38 may form a seal with the insertion connection member described below in one embodiment. In one implementation, member 38 is an annular ring about a portion of sleeve 24.

Figure 7:
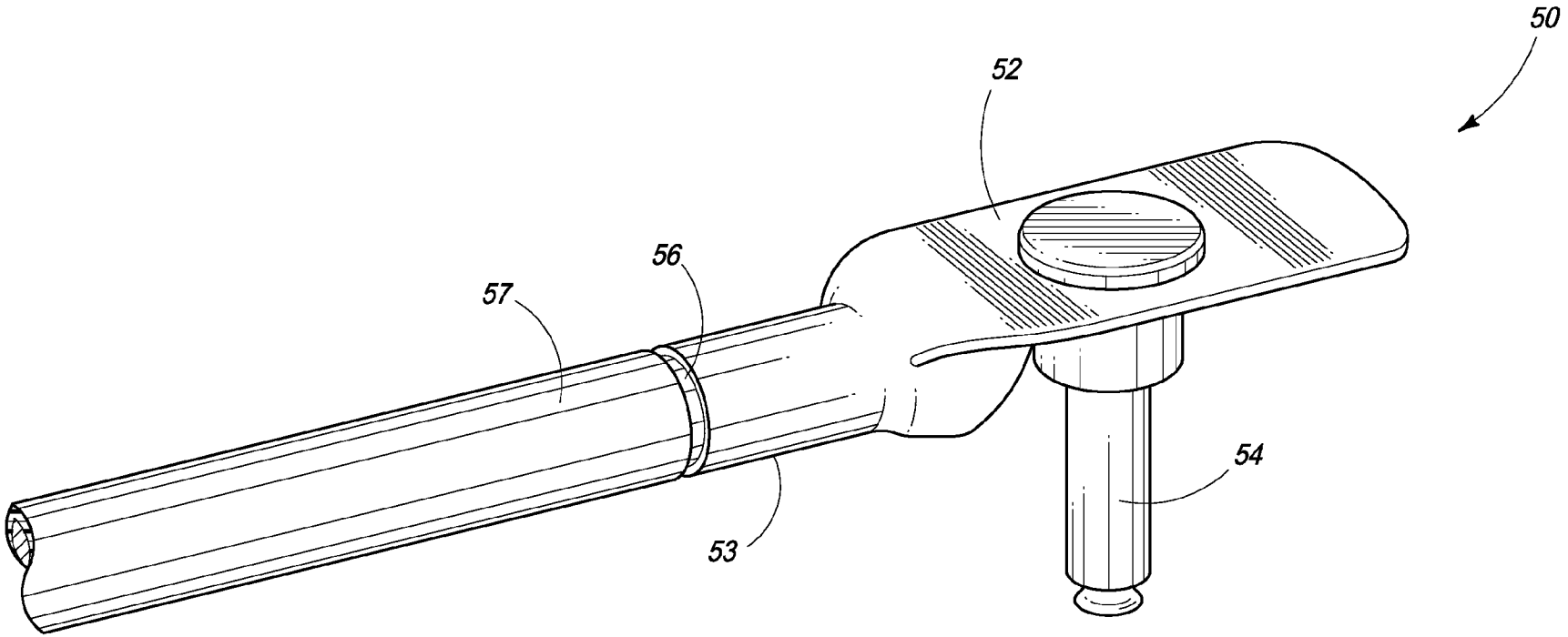
FIG. 7 is a perspective view of an insertion connection member of an electrical connection system according to one embodiment.

Referring to FIG. 7, an insertion connection member 50 is shown according to one embodiment. Insertion connection member 50 is configured to electrically couple with the receptacle connection member 20 in one embodiment. Insertion connection member 50 includes an electrically conductive lug 52 which is electrically coupled with an electrically conductive post 54. In example embodiments, lug 52 and post 54 are suitable metal conductors or suitable plated metallic conductors.

In one embodiment, lug 52 includes a clamp portion 53 which is configured to receive and be attached to an electrical wire conductor 56, such as a power cable, which is received within clamp portion 53. The affixment of the lug 52 and conductor 56 may be accomplished by crimping, soldering, clamping, or some combination of the above in illustrative examples. An electrically insulating plastic or other material 57 may be provided about wire conductor 56. In one embodiment, the post 54 may be press fit through the lug 52 and perhaps soldered or welded.

Figure 8:
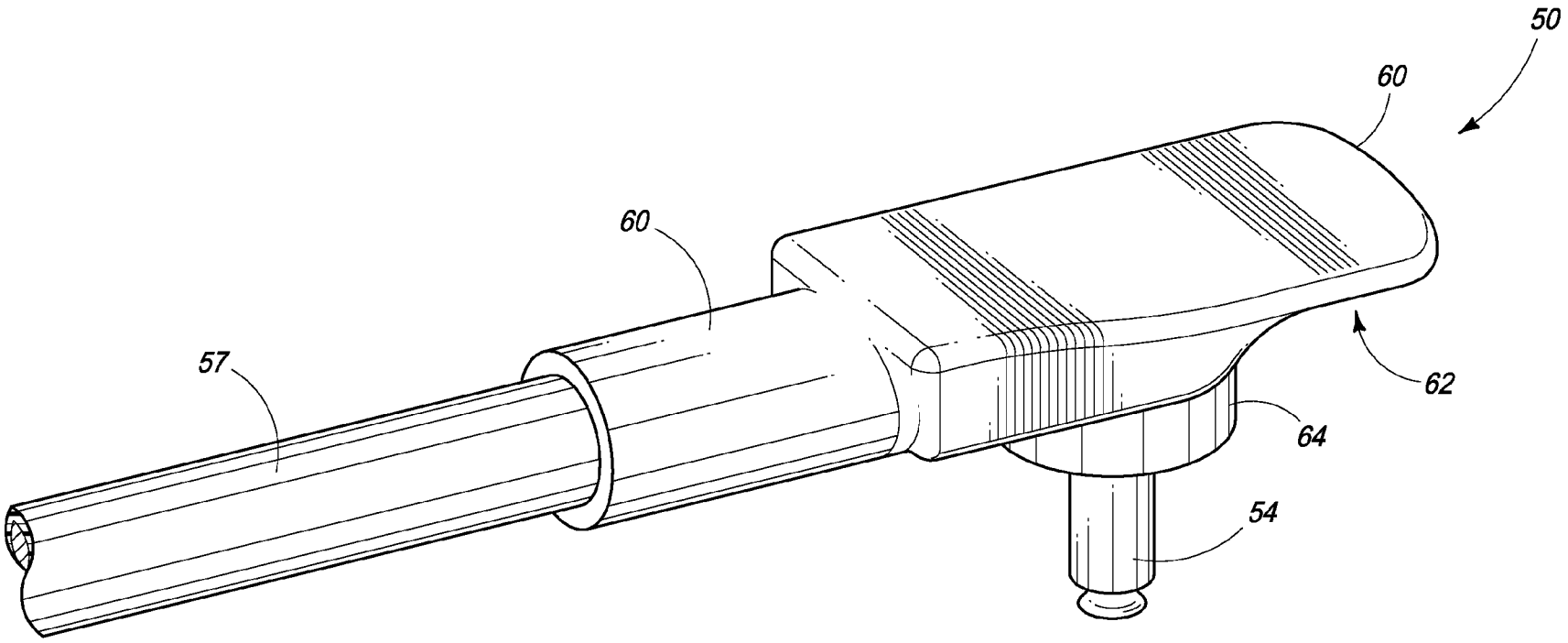
FIG. 8 is a perspective view of an insertion connection member of an electrical connection system according to one embodiment.

Referring to FIG. 8, an electrically insulative material 60, such as overmolded plastic, may be provided about the conductive lug 52 and a portion of post 54 of the insertion connection member 50 as well as a portion of the conductor 56. In one embodiment, the material 60 may also include or form an extension member 62 which extends outwardly from post 54 and opposite to conductor 56 and which is configured to assist with the electrical coupling and decoupling of the insertion connection member 20 and the receptacle connection member 50 as discussed in further detail below. In one embodiment, the extension member 62 is substantially perpendicular to the post 54 and extends outwardly from the post 54 a distance which is approximately the same as the length of the electrically conductive post 54.

The extension member 62 provides a relatively large flat area on the upper part of the insertion connection member 50 which may be used by an individual to press down during insertion of the post 54 into the aperture 28 of receptacle connection member 20. Furthermore, extension member 62 provides a grippable member which may be securely gripped by an individual and used to assist with detachment of the connection members 20, 50 including pulling the post 54 of the insertion connection member 50 out of the receptacle connection member 20. The extension member 62 may be configured in one embodiment with a reasonably high degree of stiffness and which may be gripped by a user to overcome a spring retention force which may be implemented to retain the post 54 within the sleeve 24 and assist with removal of the insertion connection member 50 from the receptacle connection member 20.

Figure 9:
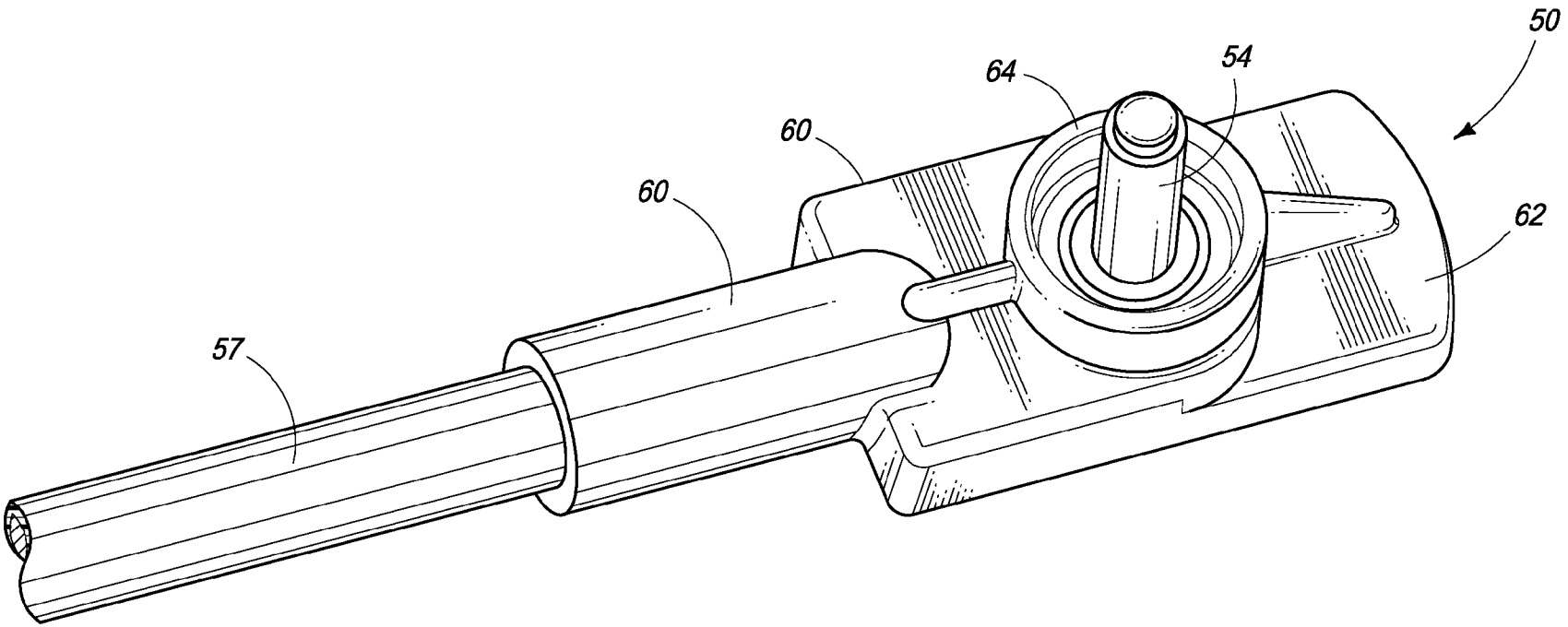
FIG. 9 is a perspective view of an insertion connection member of an electrical connection system according to one embodiment.

Referring to FIG. 9, material 60 is also molded to provide an electrically insulative member 64 coaxially about the post 54 in one embodiment. The electrically insulative member 64 is in the form of an annular ring which is spaced from the post 54 in one embodiment. Member 64 operates to provide a sealing function with the receptacle connection member 20 as described further below in one embodiment.

Figure 10:
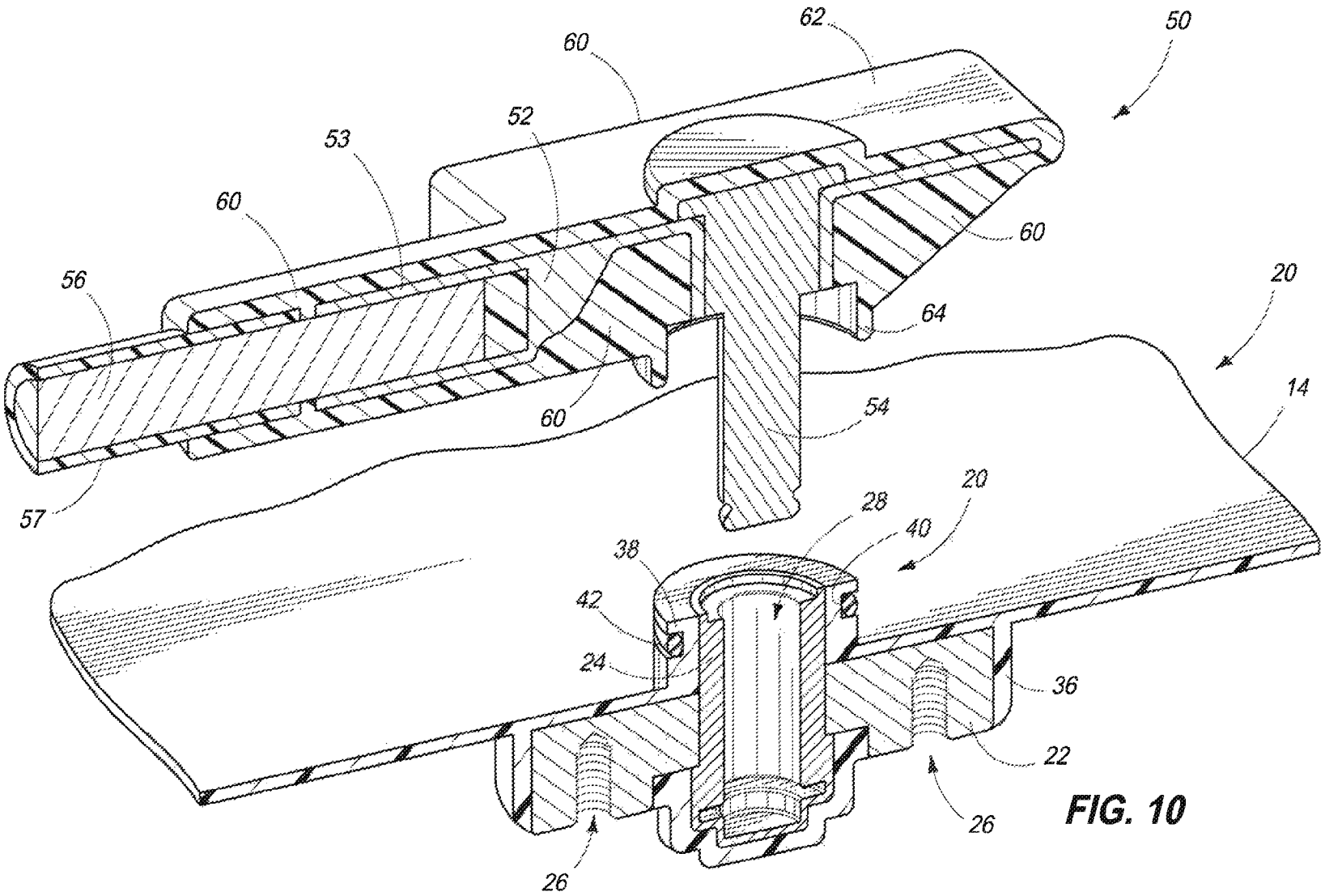
FIG. 10 is a cross-sectional view of an electrical connection system according to one embodiment.

Referring to FIG. 10, interaction of the receptacle and insertion connection members 20, 50 is described in one embodiment. For electrical coupling of receptacle and insertion connection members 20, 50, post 54 is inserted into aperture 28 of sleeve 24 and may be retained within the sleeve 24 by a spring-loaded or other retention device (not shown) which may reduce walking wherein the post 54 may back out of the sleeve 24. As previously mentioned, the extension member 62 may provide a gripping surface which may be grasped by an individual to assist with overcoming the retention force provided by the retention device and to assist with removal of the post 54 from sleeve 24.

Figure 11:
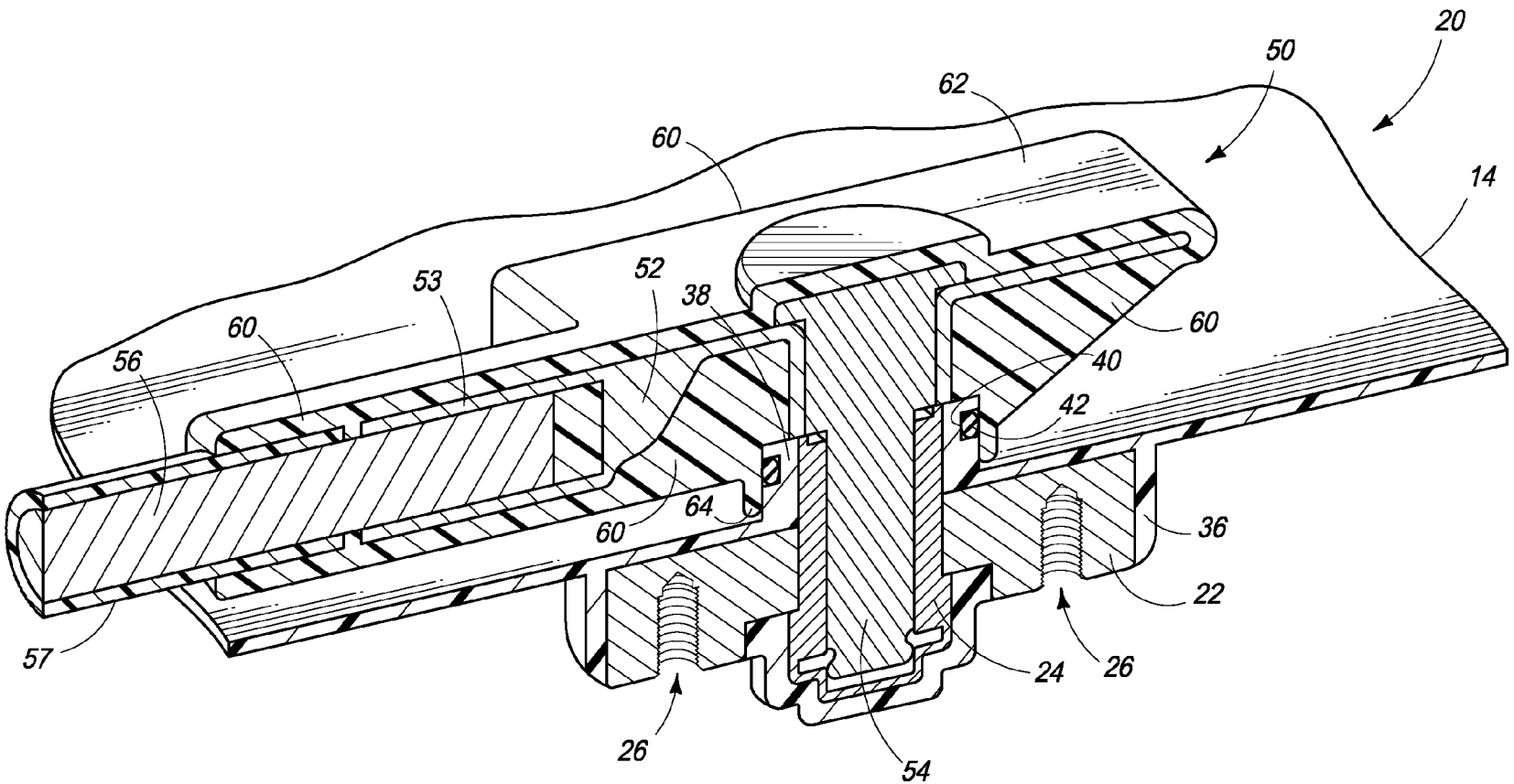
FIG. 11 is a cross-sectional view of an electrical connection system according to one embodiment.

Referring to FIG. 11, an exterior surface of post 54 and an interior surface of sleeve 24 are electrically coupled with one another upon insertion of post 54 into sleeve 24. The electrical coupling of post 54 and sleeve 24 may have lower contact resistance (resulting in reduced losses) and increased reliability and consistence compared with some other terminals, such as traditional threaded terminal connections. In this described example, wire 56 is electrically coupled with the circuitry 18 and cell 16 which are internal of the housing 14 upon insertion of the post 54 into the sleeve 24.

In one embodiment, electrically insulative members 38, 64 of receptacle and insertion connection members 20, 50, respectively, form a seal upon insertion of the post 54 of insertion connection member 50 into the aperture 28 of receptacle connection member 20. The diameter of the electrically insulative member 38 is less than the diameter of the electrically insulative member 64 and member 38 is received between the electrically conductive post 54 and the electrically insulative member 64 when the post 54 is inserted into the receptacle connection member 20. In the described embodiment, the electrically insulative members 38, 64 contact one another to form the seal during insertion of post 54 into sleeve 24. The resultant seal operates to insulate the electrically coupled post 54 and sleeve 24 from gases and liquids in the environment of the electrical apparatus 10 in one embodiment. Furthermore, the sealing arrangement provided by some configurations of the disclosure enable the electrical apparatus to be utilized in marine and other applications, and perhaps submerged into a liquid.

In one embodiment, an exterior surface of the member 38 of the receptacle connection member 20 includes a circumferential groove 40 which receives a sealing gasket 42, such as a rubber o-ring. Upon coupling of the connection members 20, 50 with one another, the gasket 42 contacts an interior surface of member 64 to form a seal. Sealing gasket 42 provides increased sealing of the sleeve 24 and post 54 with respect to the environment compared with embodiments which do not use a sealing gasket. In some implementations, groove 40 and sealing gasket 42 may be omitted and the members 38, 64 may provide resistance to splashing and dust contamination and protection from direct physical contact of the electrical connection of sleeve 24 and post 54.

Figure 12:
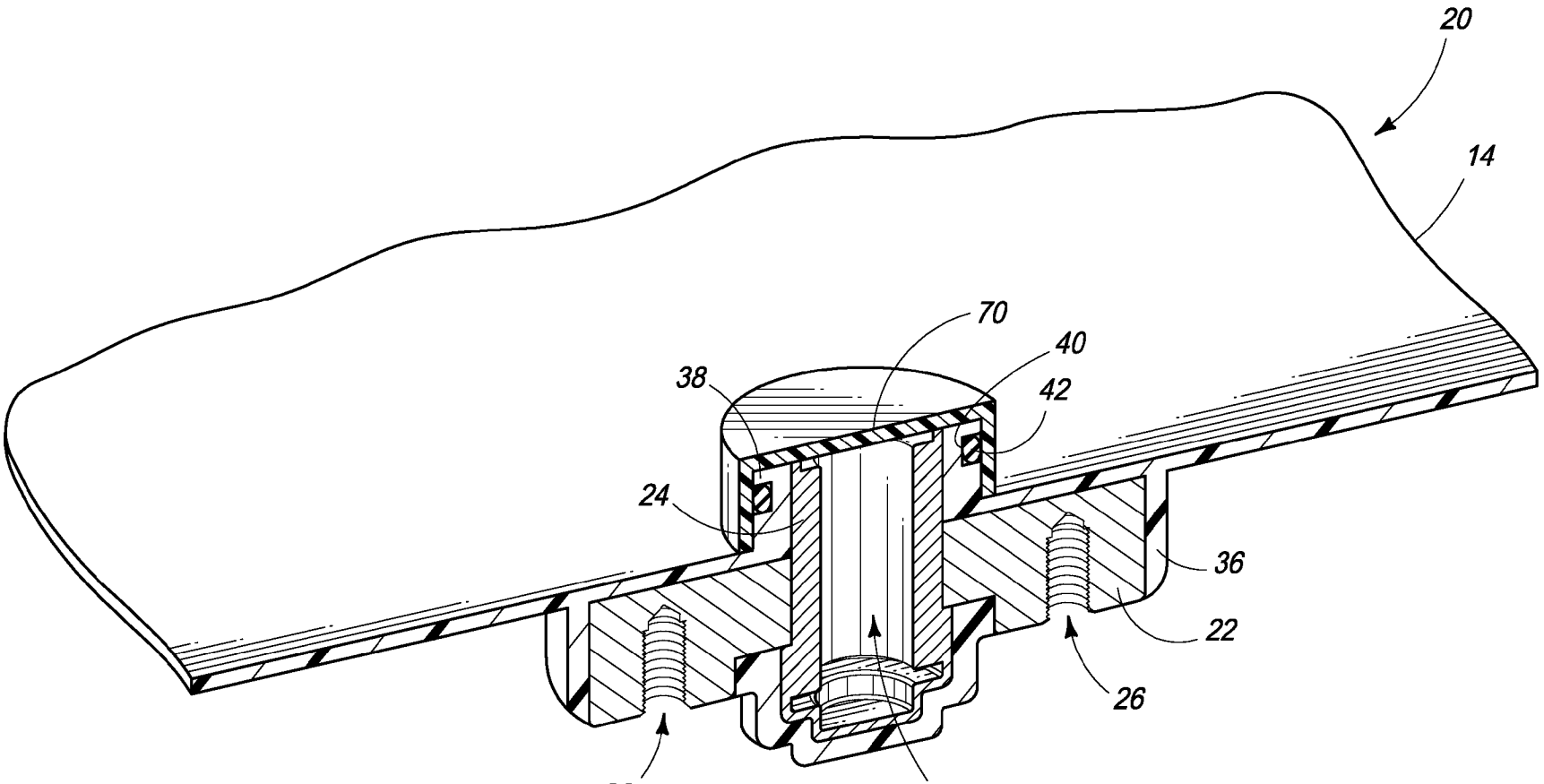
FIG. 12 is a cross-sectional view of an electrically insulative cap upon a receptacle connection member according to one embodiment.

Referring to FIG. 12, an electrically insulative cap 70, such as plastic, may be provided and shaped to fit over member 38. For example, the cap 70 may protect against accidental short circuits and prevent or reduce contamination of the receptacle connection member 20 during storage, shipping and handling.

Furthermore, different arrangements of electrically conductive members of the electrical connection system may be utilized in different embodiments, including for example, use in modular configurations. For example, the insertion connection member or receptacle connection member may include or be coupled with a y-connection for providing electrical coupling with plural wires or other conductors. Additionally, male-to-male connectors, female-to-female connectors, or external modules (e.g., current sensing devices) may also be utilized and electrically coupled with a terminal of the electrical apparatus. In some implementations, a plurality of electrical apparatus 10 may be directly coupled with one another in a mechanically-robust fashion using the example electrical connection systems of the disclosure.

As discussed according to some example embodiments, electrical connection systems are provided which enable electrical connection to one or more electrical terminal of an electrical apparatus. The electrical connection systems provide electrical connection of circuitry internal of a housing of the electrical apparatus to circuitry external of the housing in some embodiments. According to some embodiments, the electrical connection systems are sealed which protect the electrical connection members of the systems themselves as well as circuitry internal of the electrical apparatus from contaminants, such as liquid, gas, and particulate contaminants. In addition, the electrical connection systems of some embodiments may provide reduced contact resistance compared with some conventional arrangements, for example, which may use threaded fasteners. As discussed above in some illustrative examples, conductive members of the electrical connection systems may be coupled and de-coupled by hand from one another without the use of tools. Also, a plurality of easily-changeable configurations are provided in different embodiments which may include a sealing gasket for use in watertight implementations or the sealing gasket (and associated groove) may be omitted in other implementations.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

What is claimed is:

1. An electrical connection system comprising:

a receptacle connection member comprising:

an electrically conductive sleeve; and an electrically insulative member about at least a portion of an exterior surface of the sleeve; and an insertion connection member comprising:

an electrically conductive post comprising an exterior surface which is configured to be electrically coupled with an interior surface of the sleeve when the post is inserted into the sleeve; and an electrically insulative member about only a portion of a length of the electrically conductive post, and wherein the electrically insulative member of the insertion connection member is spaced from the electrically conductive post; and wherein the electrically insulative member of the receptacle connection member is received between the electrically conductive post and the electrically insulative member of the insertion connection member when the post of the insertion connection member is inserted into the sleeve.

2. The system of claim 1 wherein the electrically insulative members of the receptacle and insertion connection members form a seal when the electrically conductive post is inserted into the sleeve and which insulates the sleeve and post from an environment in which the electrical connection system is utilized.

3. The system of claim 1 wherein the electrically insulative member of the receptacle connection member includes a circumferential groove within an exterior surface of the electrically insulative member and about the sleeve.

4. The system of claim 3 further comprising a sealing gasket within the groove of the electrically insulative member to form a seal between the exterior surface of the electrically insulative member of the receptacle connection member and an interior surface of the electrically insulative member of the insertion connection member when the post is inserted into the sleeve.

5. The system of claim 1 wherein the insertion connection member comprises an extension member which extends outwardly from the post.

6. The system of claim 5 further comprising an electrically conductive cable which is electrically coupled with the post, and wherein the cable and extension member extend outwardly from the post in opposite directions which are substantially perpendicular to the post.

7. The system of claim 1 wherein the sleeve and post have a circular cross-section and the electrically insulative members of the receptacle and insertion connection member are annular rings.

8. The system of claim 7 wherein a diameter of the electrically insulative member of the insertion connection member is larger than a diameter of the electrically insulative member of the receptacle connection member.

9. The system of claim 1 wherein the insertion connection member comprises an extension member which extends outwardly in a substantially perpendicular direction from the post.

10. The system of claim 9 wherein the extension member provides a grippable member having a surface which is substantially perpendicular to the post and which may be gripped by a user to assist with detachment of the insertion connection member from the receptacle connection member.

11. The system of claim 1 wherein the insertion connection member comprises an extension member which extends outwardly from the post a distance which is approximately the same as the length of the electrically conductive post.

12. The system of claim 1 wherein the insertion connection member comprises an electrical conductor which is coupled with the post, and wherein the post is substantially perpendicular to at least a portion of the electrical conductor which is adjacent to the post.

13. An electrical apparatus comprising:

an electrically insulative housing;

electrical circuitry within an interior of the housing; and at least one terminal comprising a receptacle connection member which is electrically coupled with the electrical circuitry within the interior of the housing, and wherein the receptacle connection member comprises an electrically conductive sleeve which defines a terminal opening and which is configured to receive and electrically couple with an insertion connection member; and wherein the receptacle connection member comprises an electrically insulative member which forms a seal with an electrically insulative member of the insertion connection member to insulate the receptacle and insertion connection members from an environment outside of the housing when the receptacle and insertion connection members are electrically coupled with one another.

14. The apparatus of claim 13 further comprising the insertion connection member which comprises an electrically conductive post which is configured to be received within the sleeve.

15. The apparatus of claim 14 wherein the housing comprises a planar surface and the insertion connection member comprises an extension member, and wherein the post is substantially perpendicular to the planar surface and the extension member is substantially parallel to the planar surface when the post is received within the sleeve.

16. The apparatus of claim 13 wherein a portion of the sleeve extends outwardly of the housing and the electrically insulative member of the receptacle connection member is provided about the outwardly extending portion of the sleeve.

17. The apparatus of claim 13 wherein an exterior surface of the electrically insulative member of the receptacle connection member comprises a circumferential groove.

18. The apparatus of claim 17 further comprising a sealing gasket within the groove and which is configured to contact an interior surface of the electrically insulative member of the insertion connection member.

19. The apparatus of claim 13 wherein the sleeve and post have a circular cross-section and the electrically insulative members of the receptacle and insertion connection member are annular rings.

20. The apparatus of claim 19 wherein a diameter of the electrically insulative member of the insertion connection member is larger than a diameter of the electrically insulative member of the receptacle connection member.

21. The apparatus of claim 13 wherein the electrical apparatus is a battery and the electrical circuitry comprises at least one electrochemical cell which is electrically coupled with a plurality of the terminals.

22. An electrical connection member comprising:

an electrically conductive lug;

an electrically conductive post which is electrically coupled with and substantially perpendicular to the lug and configured to be electrically coupled with an electrically conductive sleeve of another electrical connection member when the post is inserted into the sleeve; and an electrically insulative member about the electrically conductive post and configured to form a seal with an electrically insulative member of the another electrical connection member when the post is inserted into the sleeve.

23. The member of claim 22 wherein the insertion connection member comprises an extension member which extends outwardly from the post.

24. The member of claim 23 further comprising an electrically conductive cable which is electrically coupled with the post, and wherein the cable and extension member extend outwardly from the post in opposite directions which are substantially perpendicular to the post.

25. The member of claim 24 wherein the extension member provides a grippable member which may be gripped by a user to assist with detachment of the insertion connection member from the receptacle connection member.

26. The member of claim 24 wherein the extension member extends outwardly from the post a distance which is approximately the same as the length of the electrically conductive post.

* * * * *